United States Patent [19]

Loffelman et al.

[11] 4,125,557

[45] Nov. 14, 1978

[54] HYDROSULFITE-BLEACHABLE KETONIMINE DYES FOR PAPER

[75] Inventors: Frank F. Loffelman; Frank F. Cesark, both of Bridgewater, N.J.

[73] Assignee: American Cyanamid Company, Stamford, Conn.

[21] Appl. No.: 851,075

[22] Filed: Nov. 14, 1977

[51] Int. Cl.[2] ..... C07C 119/00

[52] U.S. Cl. ..... 260/501.18; 260/566 R; 8/7

[58] Field of Search ..... 260/566 R, 501.18

[56] References Cited

U.S. PATENT DOCUMENTS 3,923,889 12/1975 Schmeidl et al. ..... 260/566 R

*Primary Examiner*—Gerald A. Schwartz

*Attorney, Agent, or Firm*—John L. Sullivan; Bruce F. Jacobs

[57] ABSTRACT

Ketonimine dyes of the formula selected from:

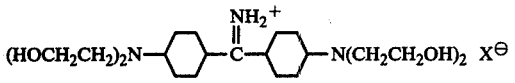

wherein X⊖ is a chloride, bromide, thiocyanate, sulfamate, formate, acetate, lactate, hydrogen sulfate or dihydrogen phosphate ion; and

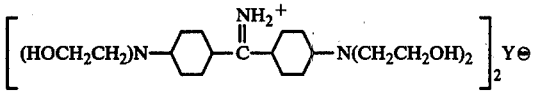

wherein Y⊖ is a sulfate or hydrogen phosphate ion are hydrosulfite bleachable dyes for paper.

5 Claims, No Drawings

HYDROSULFITE-BLEACHABLE KETONIMINE DYES FOR PAPER

This invention relates to novel hydrosulfite-bleachable dyes and to paper dyed therewith. More particularly, the invention relates to ketonimine dyes which are analogs of a class of dyes commonly called auramines.

Auramine (C.I. 41000), also called 4,4'-imidocarbonylbis(N,N-dimethylaniline)hydrochloride, represented by the formula:

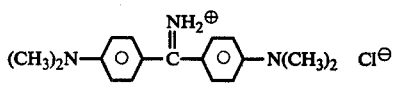

and ethyl auramine (C.I. 41001), also called 4,4'-imidocarbonylbis(N,N-diethylaniline)hydrochloride, represented by the formula:

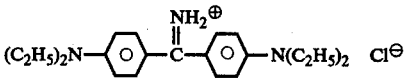

have been used for many years for dyeing paper, cotton, jute, wool, silk and acrylic fibers, as well as for the manufacture of pigments.

However, auramine and ethylauramine are not hydrosulfite-bleachable on paper. There is a need, therefore, for ketonimine dyes which can be used instead of auramine and ethylauramine and which are hydrosulfite-bleachable. Hydrosulfite-bleachable dyes are particularly desirable because there is less destruction of cellulose fibers by hydrosulfite bleaches than by chlorine bleaches.

In accordance with the present invention, a novel class of ketonimine dyes having good hydrosulfite bleachability has been found. These dyes are represented by a formula selected from formula I(a):

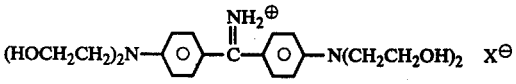

wherein $X^{\ominus}$ is an anion selected from chloride, bromide, thiocyanate, sulfamate, formate, acetate, lactate, hydrogen sulfate and dihydrogen phosphate, and formula I(b):

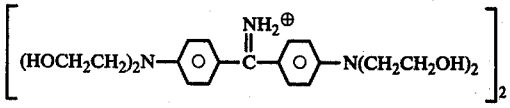

wherein $Y^{\ominus}$ is sulfate or hydrogen phosphate.

The preferred dye compounds are those represented by formula I(a) where $X^{\ominus}$ is a chloride ion, and formula I(b) where $Y^{\ominus}$ is a sulfate ion.

The novel dye compounds of this invention can be prepared by reacting N,N-bis(2-hydroxyethyl)aniline (II) with aqueous formaldehyde in the presence of a suitable acid by well-known methods (Fierz-David and Blangey, Processes of Dye Chemistry, page 137, and Merkel, German Pat. No. 1,026,322, see Chemical Abstracts 54: 18445 i), as shown below, to prepare the intermediate methane base, 4,4'-methylenebis[N-(2-hydroxyethyl)aniline], represented by formula III:

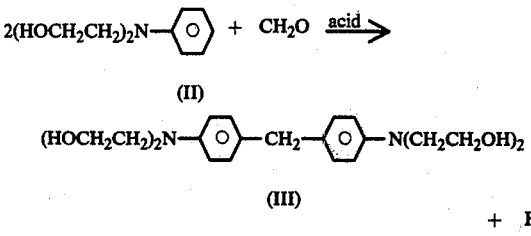

The methane base (III) can be converted to the dye product (IV) by a method disclosed by Grosklos in U.S. Pat. No. 3,668,252 wherein the methane base is heated with sulfur and ammonium chloride in ethylene glycol at a high temperature while bubbling gaseous ammonia through the reaction mixture.

(IV)

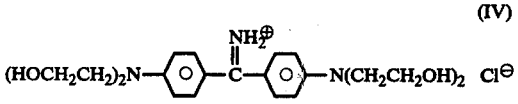

An alternative process which may be used for the conversion of methane bases to the novel dyes of this invention is disclosed by Grosklos in U.S. Pat. No. 3,268,585. This process involves the reaction of the methane base with sulfur, urea and sulfamic acid.

Other processes which may be used for the above purpose are described in U.S. Pat. Nos. 3,132,178, 3,557,212 and 3,617,183.

Illustrative examples of the novel dye compounds of this invention are the following:

4,4'-imidocarbonylbis[N,N-bis(2-hydroxyethyl)aniline] hydrochloride,
4,4'-imidocarbonylbis[N,N-bis(2-hydroxyethyl)aniline] hydrogen sulfate,
4,4'-imidocarbonylbis[N,N-bis(2-hydroxyethyl)aniline] dihydrogen phosphate,
4,4'-imidocarbonylbis[N,N-bis(2-hydroxyethyl)aniline] hydrobromide,
4,4'-imidocarbonylbis[N,N-bis(2-hydroxyethyl)aniline] sulfamate,
4,4'-imidocarbonylbis[N,N-bis(2-hydroxyethyl)aniline] acetate,
4,4'-imidocarbonylbis[N,N-bis(2-hydroxyethyl)aniline] lactate,
4,4'-imidocarbonylbis[N,N-bis(2-hydroxyethyl)aniline] formate,
4,4'-imidocarbonylbis[N,N-bis(2-hydroxyethyl)aniline] thiocyanate,
bis{4,4'-imidocarbonylbis[N,N-bis(2-hydroxyethyl) aniline]} sulfate, and
bis{4,4'-imidocarbonylbis[N,N-bis(2-hydroxyethyl) aniline]} hydrogen phosphate.

The formula I(a) type compounds wherein the anion is other than the chloride ion may be prepared by neutralizing a compound where $X^{\ominus}$ is the chloride with an equimolar amount of base and recovering the free base. The free base (which itself is a new compound) may then be suspended in acetone and neutralized with an equimolar amount of the appropriate acid, hydrobromic, sulfuric, phosphoric, sulfamic, formic, acetic, lactic or thiocyanic, etc. The precipitated dye is then recovered by filtration, washed with acetone and dried under vacuum. In the case of polybasic acids, such as sulfuric acid and phosphoric acid, the final product may contain some salts of the formula I(b) type. The compounds of the formula (Ib) type may be prepared as described above utilizing one mole of free base and one-half mole of sulfuric or phosphoric acids, respectively. In this case, the final product may contain some formula I(a) type salts.

In another method 4,4'-imidocarbonylbis[N,N-bis(2-hydroxyethyl)aniline] hydrochloride is dissolved in water and the desired compound is precipitated from solution by adding a large amount of an inorganic salt such as sodium hydrogen sulfate, sodium dihydrogen phosphate, potassium bromide, sodium sulfamate, sodium acetate, sodium lactate, sodium formate, sodium sulfate, sodium hydrogen phosphate, and the like. The dye is recovered by filtration, washed with acetone and dried.

The invention is illustrated by the following preparational examples and test results.

EXAMPLE 1

Preparation of 4,4'-Imidocarbonylbis[N,N-bis(2-hydroxyethyl)aniline] Hydrochloride

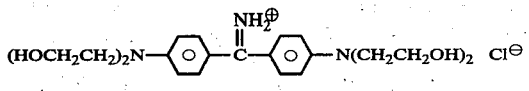

A mixture of 486.8 grams (1.3 moles) of 4,4'-methylenebis[N,N-bis(2-hydroxyethyl)aniline], 230 grams (7.2 moles) of sulfur and 800 grams of ethylene glycol was heated at 140° C. for 4 hours while a stream of ammonia gas was bubbled therein. To the reaction mixture was then added 170 grams (3.2 moles) of ammonium chloride and heating at 140° C. was continued for an additional 16 hours. The reaction mixture was cooled to 60° C., diluted with 3 liters of isopropanol, and added to diethyl ether to precipitate the dye. The dye was recovered by filtration, dissolved in 70° C. water and salted out by adding sodium chloride thereto. The resulting product was recovered and dried in vacuo. The dried tar was dissolved in 500 mls. of N,N-dimethylformamide, treated with activated carbon, filtered and precipitated by adding the filtrate to diethyl ether. This was repeated using 500 mls. of methanol. The resulting oil was recovered and triturated with isopropanol and diethyl ether to effect crystallization. The crystals were dried in vacuo to obtain 95 grams of product, which was found to be pure by thin layer chromatography.

EXAMPLE 2

(A) Preparation of 4,4'-Imidocarbonylbis[N,N-bis(2-hydroxyethyl)aniline]

A solution of 80 grams (0.188 mole) of the product of Example 1 is dissolved in 2400 mls. of ethyl alcohol and made alkaline to phenolphthalein indicator paper by adding concentrated ammonium hydroxide thereto. The solution is cooled in an ice bath and diluted with 1200 mls. of ice (5° C.) water. The resulting precipitate is separated by filtration and dried in a vacuum oven to obtain 48 grams of product. This free base is believed to be a new compound and is claimed as such herein.

(B) Preparation of Bis{4,4'-imidocarbonylbis[N,N-bis(2-hydroxyethyl) aniline]} Sulfate A solution of 12 grams (0.031 mole) of the product obtained in A (above) in 100 mls. of acetone is cooled to 0° C. and 1.5 grams (0.015 mole) of concentrated sulfuric acid is added thereto while stirring the reaction mixture. The resulting precipitate is separated by filtration, washed with cold acetone and dried to obtain 10 grams of the desired product.

EXAMPLE 3

Preparation of 4,4'-Imidocarbonylbis[N,N-bis(2-hydroxyethyl)aniline] Acetate Following the procedure of Example 2(B) substituting 1.86 grams (0.031 mole) of glacial acetic acid for the sulfuric acid, the desired product is obtained.

EXAMPLE 4

Preparation of 4,4'-Imidocarbonylbis[N,N-bis(2-hydroxyethyl)aniline] Thiocyanate Following the procedure of Example 2(B) substituting 1.83 grams (0.031 mole) of thiocyanic acid for the sulfuric acid, the desired product is obtained.

EXAMPLE 5

Preparation of 4,4'-Imidocarbonylbis[N,N-bis(2-hydroxyethyl)aniline] Hydrogen Phosphate Following the procedure of Example 2(B) substituting 1.5 grams (0.015 mole) of phosphoric acid for the sulfuric acid, the desired product is obtained.

HYDROSULFITE BLEACHABILITY TEST

Procedure

A slurry of 4.0 grams (dry basis) of unbleached sulfite pulp in 200 mls. of water is stirred at room temperature for 5 minutes and 10 mls. of a solution of the dye under Test 1, prepared by dissolving 1 gram of the dye in 500 mls. of water, are added thereto. The slurry is then stirred at room temperature for 10 minutes, 1.5 mls. of a 4% rosin solution are added and stirring continued for an additional 10 minutes. To the slurry is then added 3 mls. of a 4% solution of aluminum sulfate and the stirring continued for an additional 15 minutes. The slurry is diluted with water to a volume of 400 mls., stirred for an additional 5 minutes and poured into a Williams mold to form a sheet for dyed paper.

The sheet is removed from the mold and a 4.0 gram portion is stirred for 5 minutes in 400 mls. of hot (160°–180° F.) water. Sodium hydrosulfite dihydrate (0.080 gram) is then added and stirring continued for about 10 minutes to shred the sheet. The slurry is then poured into a Williams mold and a sheet of dyed paper is formed. The sheet is then pressed under a hydraulic press and placed on a dryer for about 6 minutes. The precent bleachability is then estimated by visual observation and compared with a standard prepared in the same manner without sodium hydrosulfite.

Following the above-described procedure, auramine, ethyl auramine and the dye of Example 1 hereinabove, were tested with the results shown in Table I.

Table I

| Dye | Test Result |
|---|---|
| Auramine | Non-bleachable |
| Ethyl auramine | Non-bleachable |
| Dye of Example 1 | 50% bleachable |

Substantially equivalent test results to those of Example 1 are obtained using the dyes of Examples 2–5.

We claim:

1. A ketonimine dye of the formula selected from

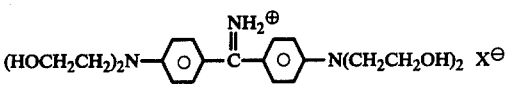

I(a)

wherein $X^{\ominus}$ is a chloride, bromide, thiocyanate, sulfamate, formate, acetate, lactate, hydrogen sulfate or dihydrogen phosphate ion; and

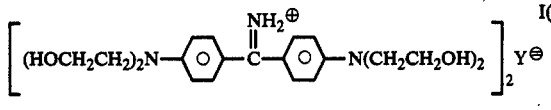

I(b)

wherein $Y^{\ominus}$ is sulfate or hydrogenphosphate ion.

2. A ketonimine dye of claim 1 wherein $X^{\ominus}$ is a chloride ion.

3. The ketonimine dye of claim 1 wherein $X^{\ominus}$ is an acetate ion.

4. The ketonimine dye of claim 1 wherein $X^{\ominus}$ is a thiocyanate ion.

5. The compound 4,4′-imidocarbonylbis[N,N-bis(2-hydroxyethyl)aniline] represented by the formula:

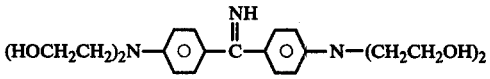

* * * * *